US008309503B2

(12) United States Patent
Fang et al.

(10) Patent No.: US 8,309,503 B2
(45) Date of Patent: Nov. 13, 2012

(54) RELEASE AGENT FOR COMPOSITE PANEL

(75) Inventors: Jiping Fang, Fort Saskatchewan (CA); Stewart Roth, Fort Saskatchewan (CA)

(73) Assignee: Guardian Chemicals Inc., Fort Saskatchewan, Alberta (CA)

( * ) Notice: Subject to any disclaimer, the term of this patent is extended or adjusted under 35 U.S.C. 154(b) by 146 days.

(21) Appl. No.: 12/533,803

(22) Filed: Jul. 31, 2009

(65) Prior Publication Data

US 2010/0048444 A1 Feb. 25, 2010

Related U.S. Application Data

(60) Provisional application No. 61/136,210, filed on Aug. 19, 2008.

(51) Int. Cl.

| | |
|---|---|
| ***C11D 1/00*** | (2006.01) |
| ***C11D 1/72*** | (2006.01) |
| ***C11D 3/36*** | (2006.01) |

(52) U.S. Cl. ..... 510/200; 510/421; 510/436; 510/437; 510/467; 510/488; 510/505

(58) Field of Classification Search ..... 510/200, 510/421, 436, 467, 488, 505
See application file for complete search history.

(56) References Cited

U.S. PATENT DOCUMENTS 4,854,333 A * 8/1989 Inman et al. ..... 132/209
5,260,051 A * 11/1993 Cho ..... 424/57
5,427,707 A * 6/1995 Drapier et al. ..... 510/222

* cited by examiner

*Primary Examiner* — Gregory DelCotto

(57) ABSTRACT

The present invention is directed to a pMDI release agent that is simple to manufacture and use, provides release between the board and the metal surfaces, allows for production of OSB at high temperature, without causing excessive press buildup and improves the board physical properties and shortens press time. The release agent composition for use with a pMDI adhesive comprises a mixture of: (a) a sodium salt of a fatty acid having at least 8 carbon atoms, and (b) a sodium salt of a phosphate ester having 8-12 carbon atoms.

9 Claims, No Drawings

RELEASE AGENT FOR COMPOSITE PANEL

CROSS REFERENCE TO RELATED APPLICATION

This application claims priority under 35 USC 119(e) to provisional application 61/136,210, filed Aug. 19, 2008.

FIELD OF THE INVENTION

The present invention is directed to a novel release agent specially designed for use in the production of manufactured wood products, in particular fibreboard and oriented strand board using 100% polymeric dimethyl phenate di-isocyanate (pMDI) adhesive.

BACKGROUND OF THE INVENTION

The manufacture of wood products such as fiberboard and Oriented Strands Board (OSB) from a mixture of wood fibers or chips, wax emulsion and adhesives is well known. Typically, the wood fibers or chips are mixed with a suitable adhesive and wax emulsion and the mixture is then matted and pressed under high pressure and temperature to form a rigid, dense panel. OSB is manufactured using strands sliced from logs in the orientation of the grain. Typically the strands are 4-6 inches in length and 1 inch wide and have a uniform thickness. After drying and sorting, the strands are mixed with the wax and adhesive and oriented in layers. The strands in the layers which will form the exterior surface of the panel are aligned in the long direction of the panel while the inner layers are cross-aligned to the surface layers.

The adhesives commonly employed in the manufacture of OSB include phenolic resins or isocyanate binders. Phenolic resins, produced by reacting phenol with formaldehyde under alkaline conditions have been used for many years. Recently, there have been concerns raised about the production, use and handling of such resins and a number of manufacturers have switched to using isocyanate binders. Liquid polymeric dimethyl phenate di-isocyanate (pMDI) is now becoming the binder of choice. pMDI is an excellent adhesive and provide advantages for the board over other adhesives. However, pMDI provides adhesions not only for the wood fibers, also for the boards to the metal press platens, caul plates or stainless steel screens used in the manufacturing process. Therefore, many OSB producers will use a surface layer of non-pMDI bonded wood chips, such as Phenol formaldehyde resin, and use pMDI in the core layer of the board to prevent the adhesion between pMDI in the OSB and the metal surfaces. This complicated surface-core sandwiching process has increased the cost of board manufacturing, and has prevented the industry from benefiting fully from pMDI adhesive.

There have been attempts to overcome the above bonding to the metal surfaces through the use of release agents. Conventional release agents as used in the industry do not provide satisfactory release. Some of these require elaborate and costly processes for pre-treatment of the press platens, such as applying internal and external release agents, multiple coatings and baking the platens. Other release agents can provide good release, but must be applied in high concentration of up to 80% and require much lower press temperatures and longer press time, thus increasing production time and cost. Some release agents based on higher surface active materials such as silicones may remain associated with the finished OSB surface and thus affect the paintability of the OSB. Up to today, a satisfactory release agent for fully pMDI bonded OS is still not available. Thus there still remains a need for a pMDI release agent which will provide the release between the board and the metal surfaces using a simple application process and allow for production of OSB at high temperature, such as 410° F., without causing excessive press buildup.

SUMMARY OF THE INVENTION

The present invention is directed to a pMDI release agent that is simple to manufacture and use, provides release between the board and the metal surfaces, allows for production of OSB at high temperature, without causing excessive press buildup and improves the board physical properties and shortens press time.

In an aspect of the invention, there is provided a release agent composition for use with a pMDI adhesive comprising a mixture of:

(a) an alkali metal salt of a fatty acid having at least 8 carbon atoms, and (b) an alkali metal salt of a phosphate ester having 8-16 carbon atoms.

In another aspect of the invention, the release agent composition further includes (c) an ethoxylated fatty alcohol having an alkyl chain length of 8-16 carbon atoms.

In a further aspect of the invention, the release agent composition comprises (a) 5-20% by weight of an alkali metal salt of a fatty acid having at least 8 carbon atoms;

(b) 5-20% by weight of an alkali metal salt of a phosphate ester having 8-16 carbon atoms;

(c) 0-5% by weight of an ethoxylated fatty alcohol having an alkyl chain length of 8-16 carbon atoms; and (d) 75-90% by weight deionized water.

In a further aspect of the invention, the release agent composition comprises (a) 10% by weight of an alkali metal salt of a fatty acid having at least 8 carbon atoms;

(b) 10% by weight of an alkali metal salt of a phosphate ester having 8-12 carbon atoms;

(c) 0-2.5% by weight of an ethoxylated fatty alcohol having an alkyl chain length of 8-16 carbon atoms; and (d) 77.5-80% by weight deionized water.

In yet another aspect of the invention the alkali metal salt of the fatty acid and the phosphate ester is a sodium salt.

DETAILED DESCRIPTION OF THE PREFERRED EMBODIMENTS

The present invention is directed to a pMDI release agent that is simple to manufacture and uses provides release between the board and the metal surfaces, allows for production of OSB at high temperature, without causing excessive press buildup and improves the board physical properties and shortens press time.

The release agent composition for use with a pMDI adhesive comprises a mixture of:

(a) an alkali metal salt of a fatty acid having at least 8 carbon atoms, and (b) an alkali metal salt of a phosphate ester having 8-16 carbon atoms.

The alkali metal salt of the fatty acid is used as a surfactant and has at least 8 carbon atoms in the fatty acid. Preferably, the number of carbon atoms is between 8 and 22, more preferably between 8 and 16 and most preferably between 8 and 10. The fatty acid may be saturated or unsaturated with unsaturated fatty acids being preferred. The fatty acid may be a single fatty acid such as palmitic acid, oleic acid, or linoleic acid or it may be a mixture of fatty acids such as is found in a preparation such as tall oil fatty acid. The alkali metal salt of the fatty acid is preferably produced by mixing an alkali metal hydroxide solution with the fatty acid until the reaction completes. The amount of the alkali metal salt of the fatty acid in the compositions of the present invention will be between 5% and 20% by weight, more preferably between 5% and 15% by weight, most preferably about 10% by weight, based on the total weight of the composition.

The alkali metal salt of a phosphate ester is believed to bond to the metal of the plates and aid in the release properties of the alkali metal of the fatty acid. The alkali metal salt of a phosphate ester preferably has 8-16 carbon atoms, more preferably 8-12 carbon atoms. Straight or branched chains or cyclic groups of the phosphate ester may be used. The amount of the alkali metal salt of the phosphate ester in the compositions of the present invention will be between 5% and 20% by weight, more preferably between 5% and 15% by weight, most preferably about 10% by weight, based on the total weight of the composition.

The alkali metal salt of the fatty acid or the phosphate ester may be any of the commonly employed alkali metal salts. Preferably, the alkali metal salt is a potassium, sodium or lithium salt, more preferably potassium or sodium salt, most preferably a sodium salt.

In addition to the above two components, the composition of the present invention may optionally contain other components such as other surfactants, etc., so long as they do not impact the functioning of the release agent. For example, other surfactants, such as fluorinated or siliconated surfactants can be used in the formula to promote the wetting and penetration ability. One preferred additional component is an ethoxylated fatty alcohol having an alkyl chain length of 8-16 carbon atoms. More preferably, the ethoxylated fatty alcohol has an alkyl chain length of 10-16 carbon atoms with from 3 to 12 ethoxyl groups. The alkyl group of the ethoxylated fatty alcohol may be straight or branched or cyclic, more preferably straight or branched alkyl chains. Such additional components can be present in amount up to about 5% by weight of the composition.

In addition to the above components, the composition will contain water and an agent to adjust the pH to the preferred range of 8 to 10, most preferably about pH 9. Preferably, NaOH or KOH is used to adjust the pH.

Once formulated, the composition of the present invention is used as a release agent for OSB and other manufactured wood product production utilizing pMDI as the adhesive. The composition of the present invention is applied to either the surface of the mat of fibers used to form the manufactured wood product or to the surfaces of the caul plates used in the presses. Preferably, the composition is applied to the caul plates to ensure uniform coating of the release agent. The composition is generally applied to the surfaces of the caul plates at a spray rate of at least 2.5 g/sq. ft and preferably at a spray rate of at least 5 g/sq. ft when applying the composition to the surface of the mat fibers, spray rates of up to 20 g/sq. ft may be used. The composition of the present invention provides for excellent release of the finished wood product from the caul plates.

The following examples are illustrative of the preferred embodiments of the present invention, but the present invention is not limited to the examples.

Example 1

Preparation of Release Agent Composition 73.02 g of deionized water was weighed in a beaker followed by the addition of 2.57 g of 50% NaOH while mixing; Then 10.07 g of tall oil was added and mixed until a clear yellow liquid was obtained. 10.48 g of Poly (oxo-1,2-ethanediyl), α-hydro-ω-hydroxy-, mono-C8-10-alkyl ethers phosphate ester was added while mixing for 10 minutes; Then 3.86 g of 50% NaOH was added while mixing until a clear yellow viscous liquid was obtained.

Example 2

Production of OSB Samples

Two hundred pound OSB strands consisting of 95% Aspen and 5% Pine were blended with pMDI-resin at 10% of the oven dry weight of the wood strands (% odw) in a 5 foot diameter by two foot deep blender. In order to effectively blend the strands for the panels, the strands were blended in 3 batches. At the onset of each panel manufacture, the caul plates were freshly sanded with 120 grit sand paper and the surface dust removed. Release Agent (RA) prepared in accordance with Example 1 was then applied to the top and bottom caul plates by spreading at rates of 2.5 or 5 g/sq. ft. Altogether nine 1¼" thick and eight 7/16" thick panels were hand formed and hot pressed to a board density of 43 lb/ft$^2$. Due to the size restriction of the small 12" by 12" hot-press, two of the 1¼" panels were manufactured on a larger 30" by 30" hot-press. Two of the 7/16" panels were pressed at a lower temperature of 380° F. to determine the impact of press temperature on the resulting panel surface color.

To test the effect of spraying RA's, as opposed to spreading, the RA was sprayed on the bottom caul plate and sprayed on the strands after forming at the rate of 5 g/sq. ft. A similar test was repeated, but the rate of RA application on the strands was doubled (10 g/ft2). These two application methods were done with 7/16" thick panels.

During the test, the various factors of temperature at 430° F., 410° F., 380° F. (mainly 410° F.), release agent concentrations (10%, 5%, 2.5%), spray rates (5 and 2.5 g/sq.ft.), and spray methods (spray directly onto the mat by a spray bottle and coat on caul plates) were investigated. The pressing time was kept between 9-12 minutes.

The release agent performed extraordinary well at a 10% concentration and 5 grams per sq. ft. spray rate without any difficult to separate the board from the caul plates at all temperatures and prolonged pressing time. The release agents performed well at lower concentration (5%) and spray rate (5 g/sq. ft) if the product is properly applied. At a concentration of 2.5% and a spray rate of 2.5 g/sq.ft., some sticking took place (some difficulty to separate the caul plate and board).

It was observed that at higher temperatures, the surface of the board tends to be darker in color presumably due to the burning of wood. Reduced press time achieved by way of steam shock to reduce the pressing time could reduce or eliminate this problem. It was also found that applying the coating release agent directly onto the caul plate performs better than the spraying onto the mat surface which requires a little more release agent. Spraying may miss some spots as pMDI has very strong adhesion to the metal.

The tested 10% resin content is very extreme in the industry and was employed to demonstrate the effectiveness of the release compositions of the present invention. The industry uses this high resin content only when they manufacture a special product The normal resin content in the industry is between 2-4% and at these concentrations, the release agent compositions of the present invention will be expected to demonstrate exceptional releasability.

The release agent compositions of the present invention are simple to manufacture and use, provide release between the board and the metal surfaces, allow for production of OSB at high temperature, without causing excessive press buildup and improve the board physical properties and shorten press time. Even at extreme pMDI concentrations of 10%, the release agent compositions of the present invention provide exceptional release characteristics with the finished board slipping easily off the plates with no sticking.

Although various preferred embodiments of the present invention have been described herein in detail, it will be appreciated by those of skill in the art that variations may be made thereto without departing from the spirit of the invention or the scope of the appended claims.

We claim:

1. A release agent composition for use with a polymeric dimethyl phenate di-isocyanate adhesive comprising a mixture of:

(a) 5-20% by weight of an alkali metal salt of a fatty acid having at least 8 carbon atoms;

(b) 5-20% by weight of an alkali metal salt of a phosphate ester having 8-16 carbon atoms;

(c) 0-5% by weight of an ethoxylated fatty alcohol having an alkyl chain length of 8-16 carbon atoms; and (d) 75-90% by weight deionized water, wherein the release agent provides release of a pressed wood product from a press to which the release agent is applied.

2. The release agent composition of claim 1 comprising:

(a) 10% by weight of an alkali metal salt of a fatty acid having at least 8 carbon atoms;

(b) 10% by weight of an alkali metal salt of a phosphate ester having 8-12 carbon atoms;

(c) 0-2.5% by weight of an ethoxylated fatty alcohol having an alkyl chain length of 10-16 carbon atoms with from 3 to 12 ethoxyl groups; and (d) 77.5-80% by weight deionized water.

3. The release agent composition of claim 1 wherein the alkali metal salt of the fatty acid and the phosphate ester are independently selected from a lithium, potassium or sodium salt.

4. The release agent composition of claim 1 wherein the alkali metal salt of the fatty acid and the phosphate ester are independently selected from a potassium or sodium salt.

5. The release agent composition of claim 1 wherein the alkali metal salt of the fatty acid and the phosphate ester are each a sodium salt.

6. The release agent composition of claim 2 wherein the alkali metal salt of the fatty acid and the phosphate ester are independently selected from a lithium, potassium or sodium salt.

7. The release agent composition of claim 2 wherein the alkali metal salt of the fatty acid and the phosphate ester are independently selected from a potassium or sodium salt.

8. The release agent composition of claim 2 wherein the alkali metal salt of the fatty acid and the phosphate ester are each a sodium salt.

9. The release agent composition of claim 2 comprising (a) 10% by weight of a sodium salt of a tall oil fatty acid;

(b) 10% by weight of a sodium salt of poly (oxo-1,2-ethanediyl), α-hydro-ω-hydroxy-, mono-C8-10-alkyl ether[s], phosphate ester;

(c) 0-2.5% by weight of an ethoxylated fatty alcohol having an alkyl chain length of 10-16 carbon atoms with from 3 to 12 ethoxyl groups; and (d) 77.5-80% by weight deionized water.

* * * * *